US012214470B2

(12) United States Patent
Chen

(10) Patent No.: US 12,214,470 B2
(45) Date of Patent: Feb. 4, 2025

(54) GRINDING WHEEL ASSEMBLY WITH A COOLANT PASSAGE SYSTEM

(71) Applicant: SHIN-YAIN INDUSTRIAL CO., LTD., Taichung (TW)

(72) Inventor: Pen Hung Chen, Taichung (TW)

(73) Assignee: SHIN-YAIN INDUSTRIAL CO., LTD., Taichung (TW)

( * ) Notice: Subject to any disclaimer, the term of this patent is extended or adjusted under 35 U.S.C. 154(b) by 377 days.

(21) Appl. No.: 17/714,282

(22) Filed: Apr. 6, 2022

(65) Prior Publication Data

US 2023/0321791 A1 Oct. 12, 2023

(51) Int. Cl.
*B24B 55/12* (2006.01)
*B24B 55/04* (2006.01)

(52) U.S. Cl.
CPC ..... *B24B 55/12* (2013.01); *B24B 55/045* (2013.01)

(58) Field of Classification Search
None
See application file for complete search history.

(56) References Cited

U.S. PATENT DOCUMENTS

| | | | | | |
|---|---|---|---|---|---|
| 796,466 | A * | 8/1905 | Stolzenberg | B24B 55/02 | 451/450 |
| 2,733,562 | A * | 2/1956 | Drummond | B24B 55/02 | 451/450 |
| 2,745,229 | A * | 5/1956 | Brady | B23F 23/12 | 451/450 |
| 2,840,960 | A * | 7/1958 | Booth | B24B 55/02 | 204/224 R |
| 2,857,671 | A * | 10/1958 | Nelson | A61C 1/052 | 451/450 |
| 3,144,739 | A * | 8/1964 | Brutvan | B24D 5/06 | 451/450 |
| 3,603,042 | A * | 9/1971 | Boettcher | B24B 37/102 | 451/449 |

* cited by examiner

*Primary Examiner* — Bryan R Muller
*Assistant Examiner* — Dana Lee Poon
(74) *Attorney, Agent, or Firm* — RABIN & BERDO, P.C.

(57) ABSTRACT

A grinding wheel assembly has a tool holder, a mounting shaft connected to the tool holder, and a grinding wheel mounted on the mounting shaft. The tool holder has a first coolant passage defined through the tool holder. The mounting shaft has a second coolant passage communicating with the first coolant passage. The grinding wheel has multiple third coolant passages defined through the grinding wheel and communicating with the second coolant passage. The first coolant passage, the second coolant passage, and the multiple third coolant passages are utilized for a coolant to flow through. Thereby, the grinding wheel and a workpiece can be cooled down without setting up any pipeline and nozzle for the coolant in a grinding machine.

15 Claims, 9 Drawing Sheets

GRINDING WHEEL ASSEMBLY WITH A COOLANT PASSAGE SYSTEM

BACKGROUND OF THE INVENTION

1. Field of the Invention

The present invention relates to a grinding wheel, and more particularly to a grinding wheel assembly with a coolant passage system that may cool down a grinding wheel and a workpiece without setting up any pipeline or nozzle in a grinding machine.

2. Description of Related Art

With reference to FIG. 7, a conventional grinding machine 90 has a grinding wheel 91 and a coolant system 92. The grinding wheel 91 is mounted on a spindle of the conventional grinding machine 90. The coolant system 92 is disposed on the conventional grinding machine 90 and includes at least one nozzle 921 and a pipeline 922 connected to and communicating with the at least one nozzle 921. When a workpiece 80 is grinded by the grinding wheel 91, a coolant flows through the pipeline 922 and is ejected from the at least one nozzle 921 toward a contact point of the grinding wheel 91 and the workpiece 80 to cool down the grinding wheel 91 and the workpiece 80.

However, when setting up the coolant system 92, avoiding interference between the coolant system 92 and other components in the conventional grinding machine 90 is time-consuming. The coolant system 92 also takes up space inside the conventional grinding machine 90. Moreover, since the position of the contact point between the grinding wheel 91 and the workpiece 80 may change with wear-off of the grinding wheel 91 or replacement of the grinding wheel 91, the direction of the nozzle 921 may need to be slightly adjusted, and this may also take time and cause trouble in use.

To overcome the shortcomings of the coolant system 92 in the conventional grinding machine 90, the present invention tends to provide a grinding wheel assembly with a coolant passage system to mitigate or obviate the aforementioned problems.

SUMMARY OF THE INVENTION

The main objective of the present invention is to provide a grinding wheel assembly, and particularly to a grinding wheel assembly with a coolant passage system that may cool down a grinding wheel and a workpiece without setting up any pipeline or nozzle in a grinding machine.

The grinding wheel assembly with a coolant passage system comprises a tool holder, a mounting shaft connected to the tool holder, and a grinding wheel mounted on the mounting shaft. The tool holder has a first coolant passage defined through the tool holder. The mounting shaft has a second coolant passage communicating with the first coolant passage. The grinding wheel has at least one third coolant passage defined through the grinding wheel and communicating with the second coolant passage. The grinding wheel has two side surfaces and multiple through holes defined through the grinding wheel, extending from one of the two side surfaces of the grinding wheel to the other one of the two side surfaces of the grinding wheel, and spaced from said third coolant passage. The grinding wheel assembly has multiple adjusting set screws, and the tool holder has a first flange, an inserting groove, and multiple adjusting holes.

The first flange is located at an end of the tool holder and has an outer peripheral surface and an abutting surface facing the mounting shaft. The inserting groove is formed in the first flange, formed through the abutting surface of the first flange, and surrounded by the outer peripheral surface of the first flange. The multiple adjusting holes are radially defined through the first flange and extending from the inserting groove to the outer peripheral surface of the first flange. The mounting shaft has an inserting portion disposed at the first end of the mounting shaft and inserted into the inserting groove of the tool holder. The grinding wheel assembly has multiple adjusting set screws respectively screwed into the multiple adjusting holes and abut against the inserting portion of the mounting shaft.

The first coolant passage, the second coolant passage, and the at least one third coolant passage is utilized for a coolant to flow through. Thereby, the grinding wheel and a workpiece can be cooled down without setting up any pipeline and nozzle for the coolant in a grinding machine.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
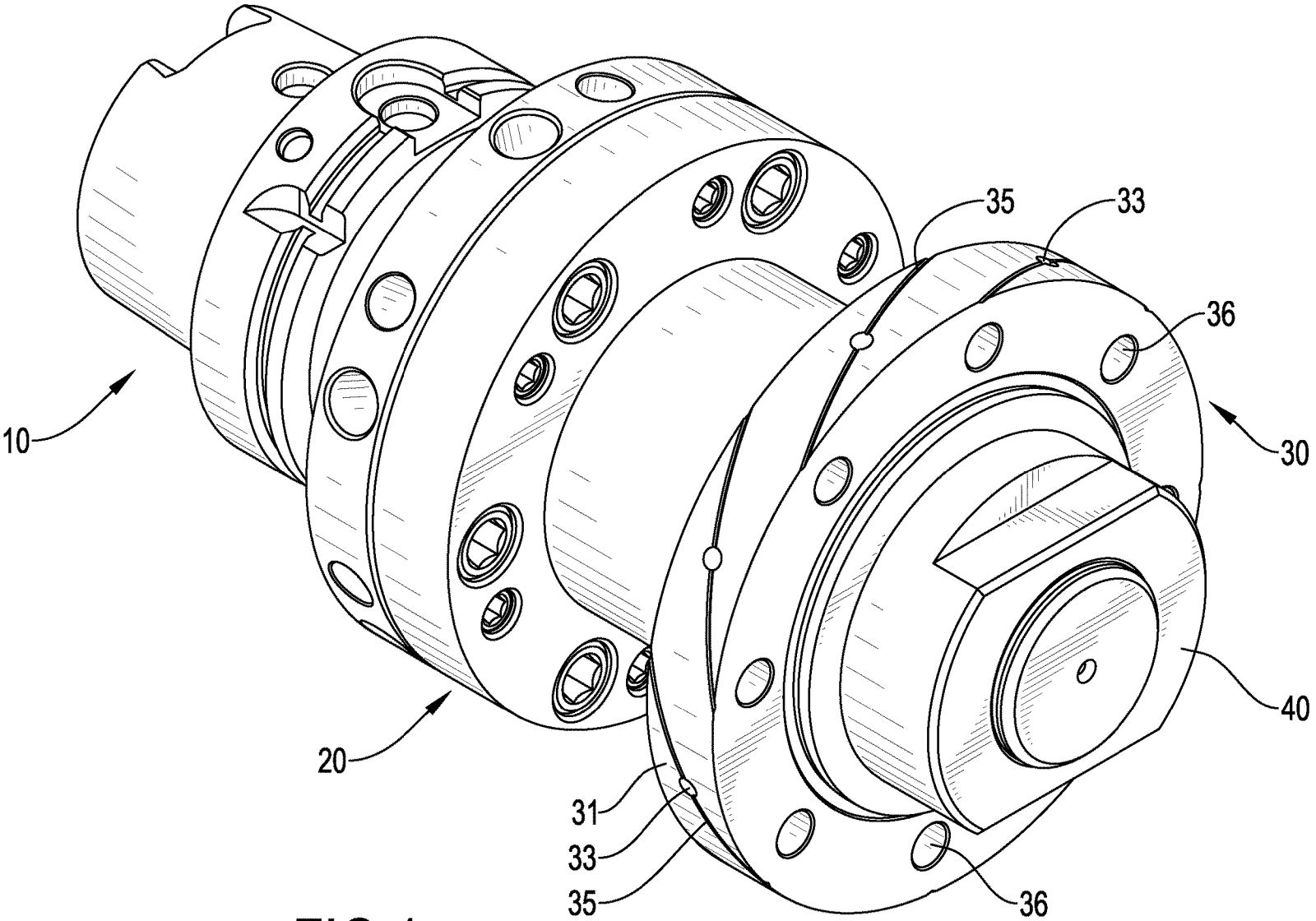
FIG. 1 is a perspective view of a grinding wheel assembly in accordance with the present invention.
Figure 2:
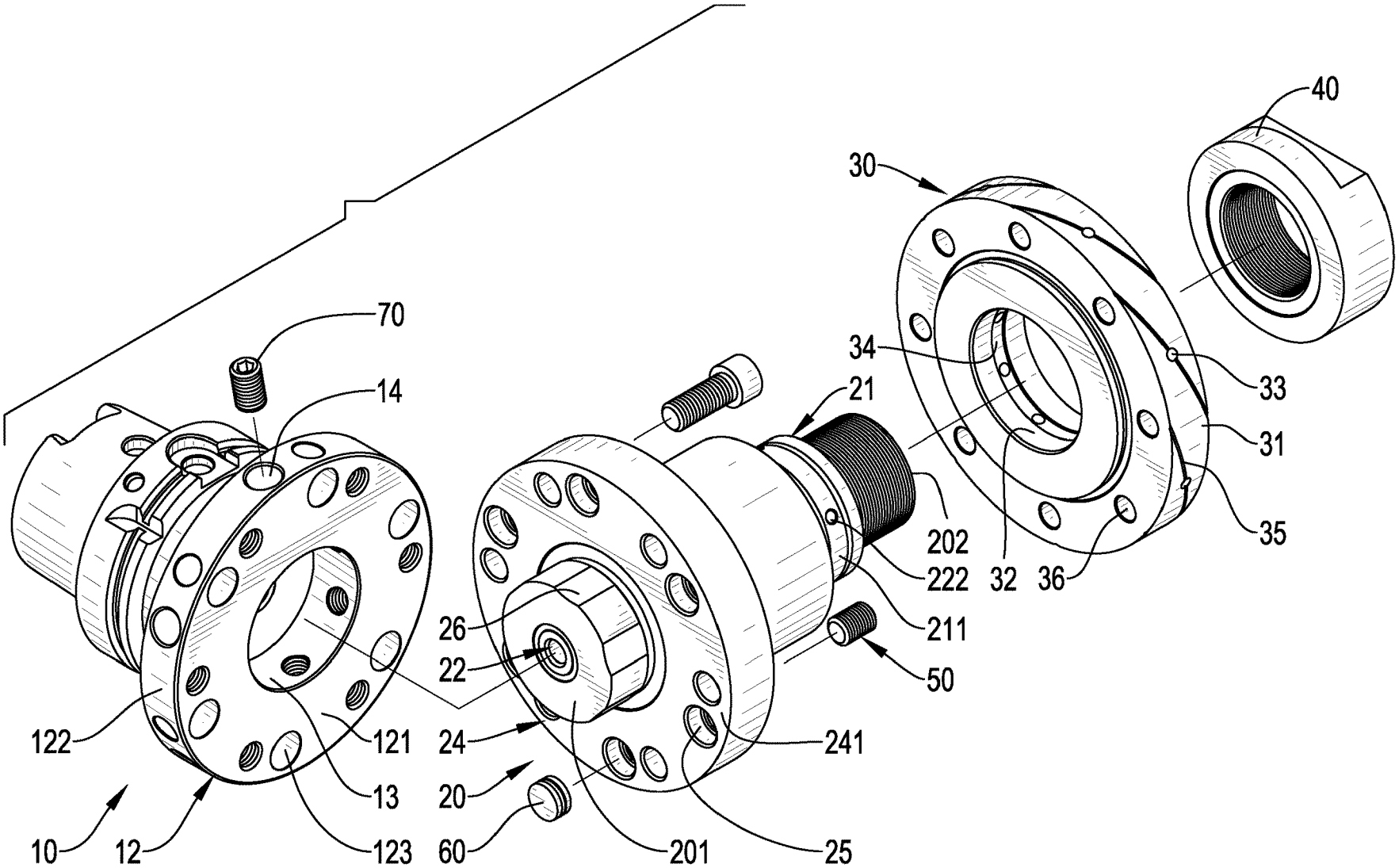
FIG. 2 is an exploded perspective view of the grinding wheel assembly in FIG. 1.
Figure 3A:
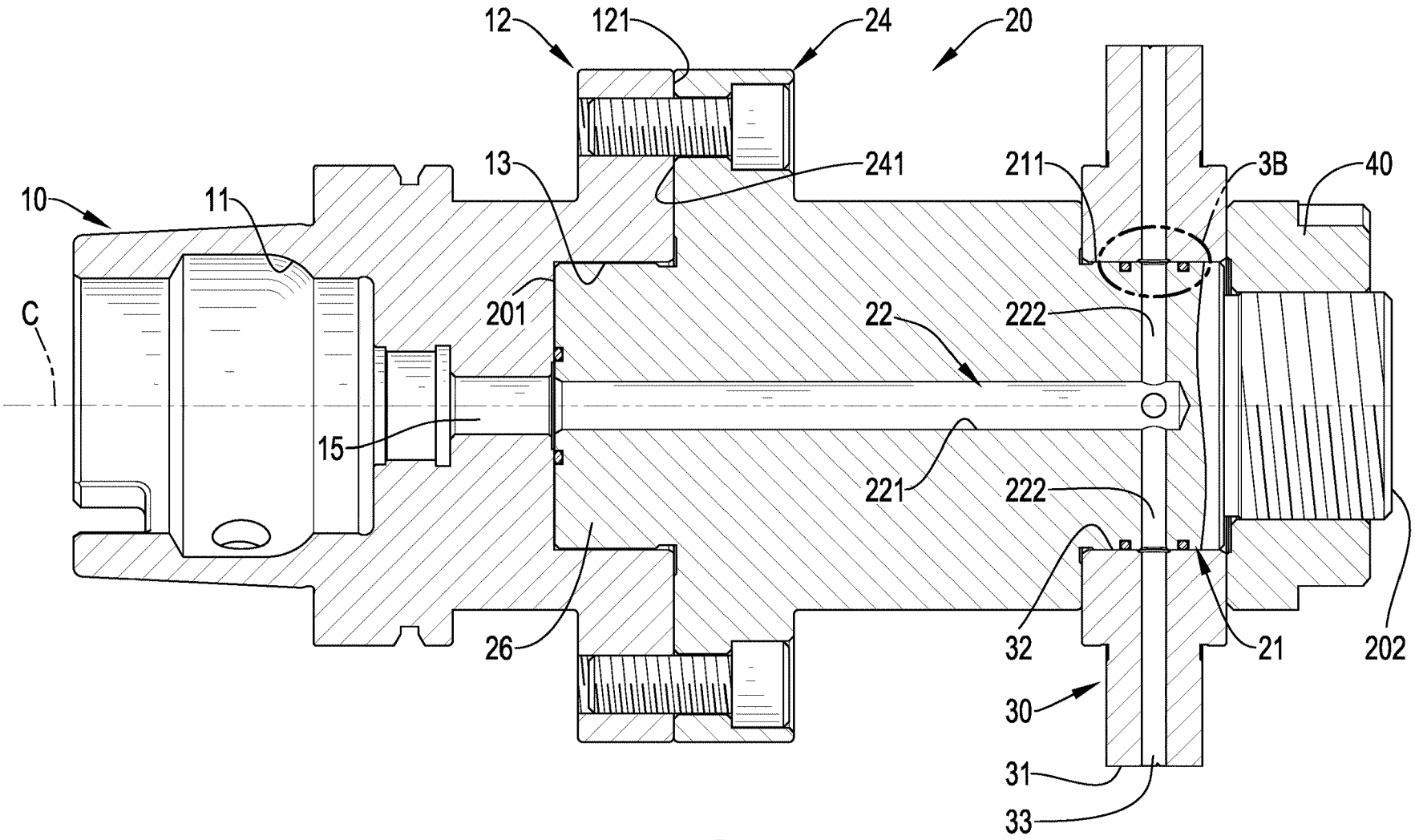
FIG. 3A is a side view in partial section of the grinding wheel assembly in FIG. 1.

With reference to FIGS. 1, 2, and 3A, a grinding wheel assembly with a coolant passage system in accordance with the present invention has a central line C, an axial direction along the central line C, a tool holder 10, a mounting shaft 20, a grinding wheel 30, a fixing nut 40, multiple pressing set screws 50, multiple spacers 60, and multiple adjusting set screws 70. The tool holder 10, the mounting shaft 20, the grinding wheel 30, and the fixing nut 40 are sequentially disposed along the axial direction of the grinding wheel assembly.

With reference to FIGS. 2 and 3A, the tool holder 10 has two ends opposite each other along an axial direction of the tool holder 10, an installing groove 11, a first flange 12, an inserting groove 13, multiple adjusting holes 14, and a first coolant passage 15. With reference to FIG. 3A, the installing groove 11 is recessed from one of the two ends of the tool holder 10 toward the other one of the two ends of the tool holder 10. With reference to FIGS. 2 and 3A, the first flange 12 has an abutting surface 121, an outer peripheral surface 122 facing the mounting shaft 20, and multiple containing recesses 123 formed on the abutting surface 121 at spaced intervals. The inserting groove 13 is formed in the first flange 12, is formed through the abutting surface 121 of the first flange 12, and is surrounded by the outer peripheral surface 122 of the first flange 12. The inserting groove 13 faces the mounting shaft 20.

Figure 5:
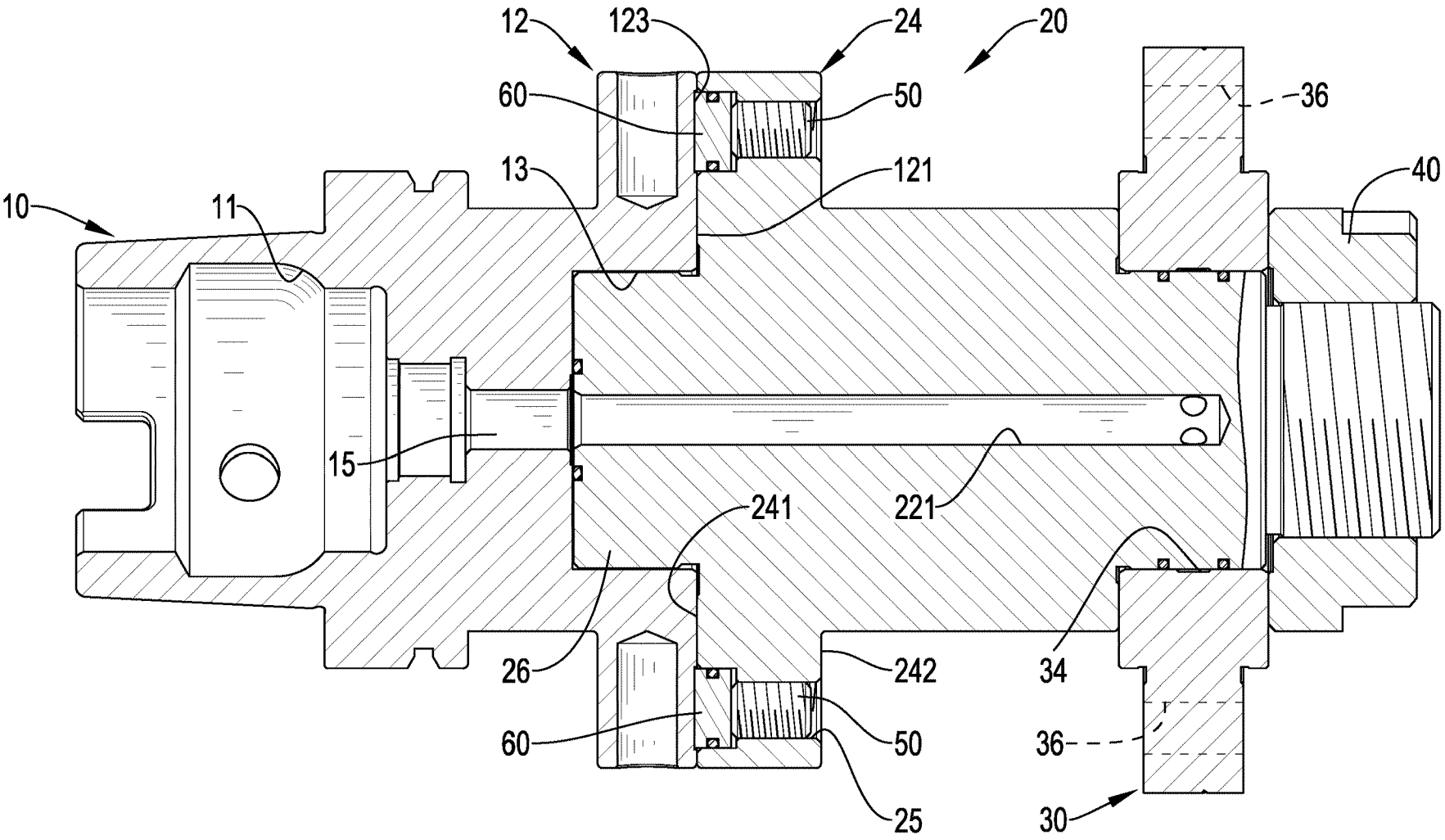
FIG. 5 is another side view in partial section of the grinding wheel assembly in FIG. 1.
Figure 6:
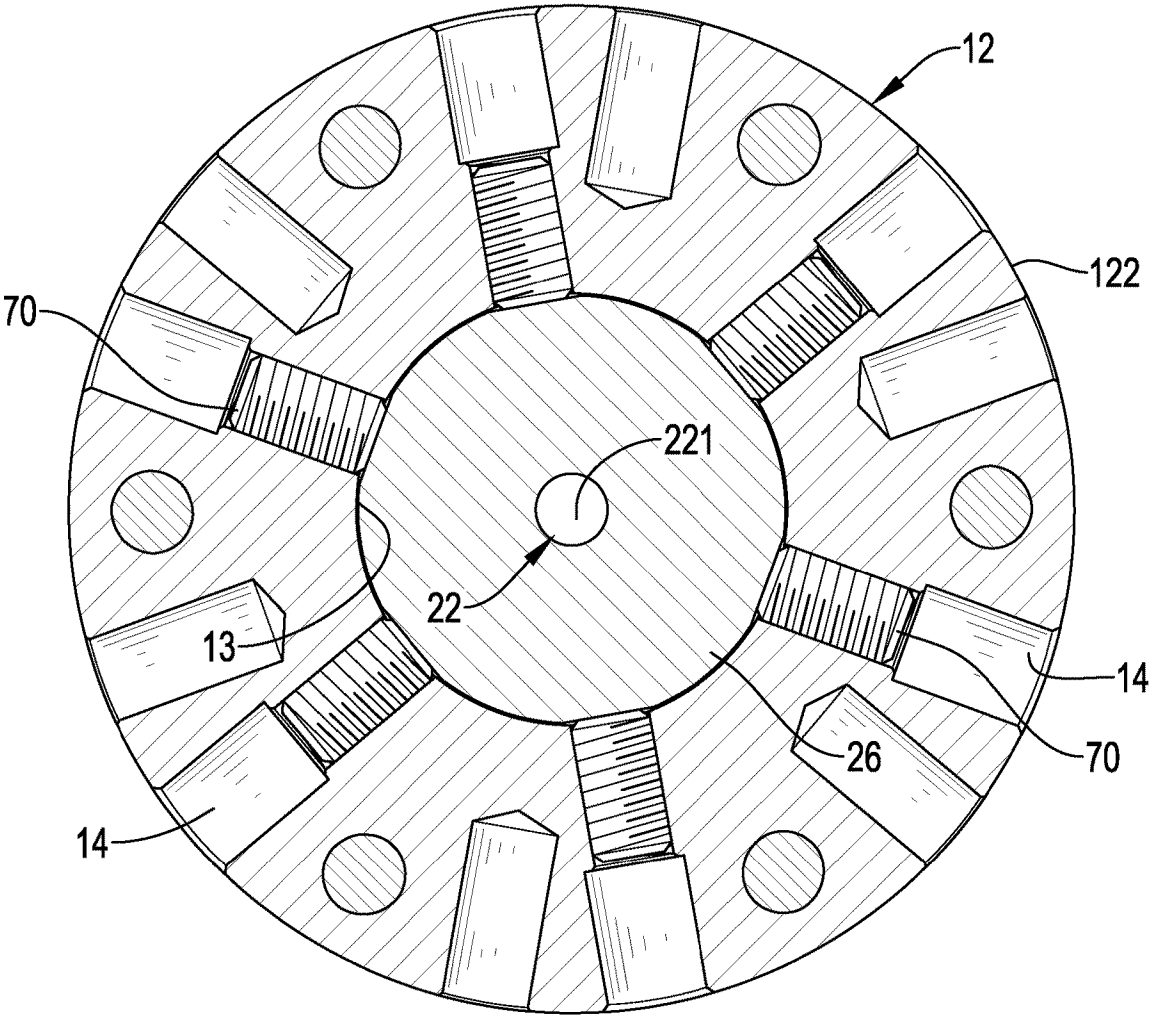
FIG. 6 is another cross-sectional front side view of the grinding wheel assembly in FIG. 1.
Figure 7:
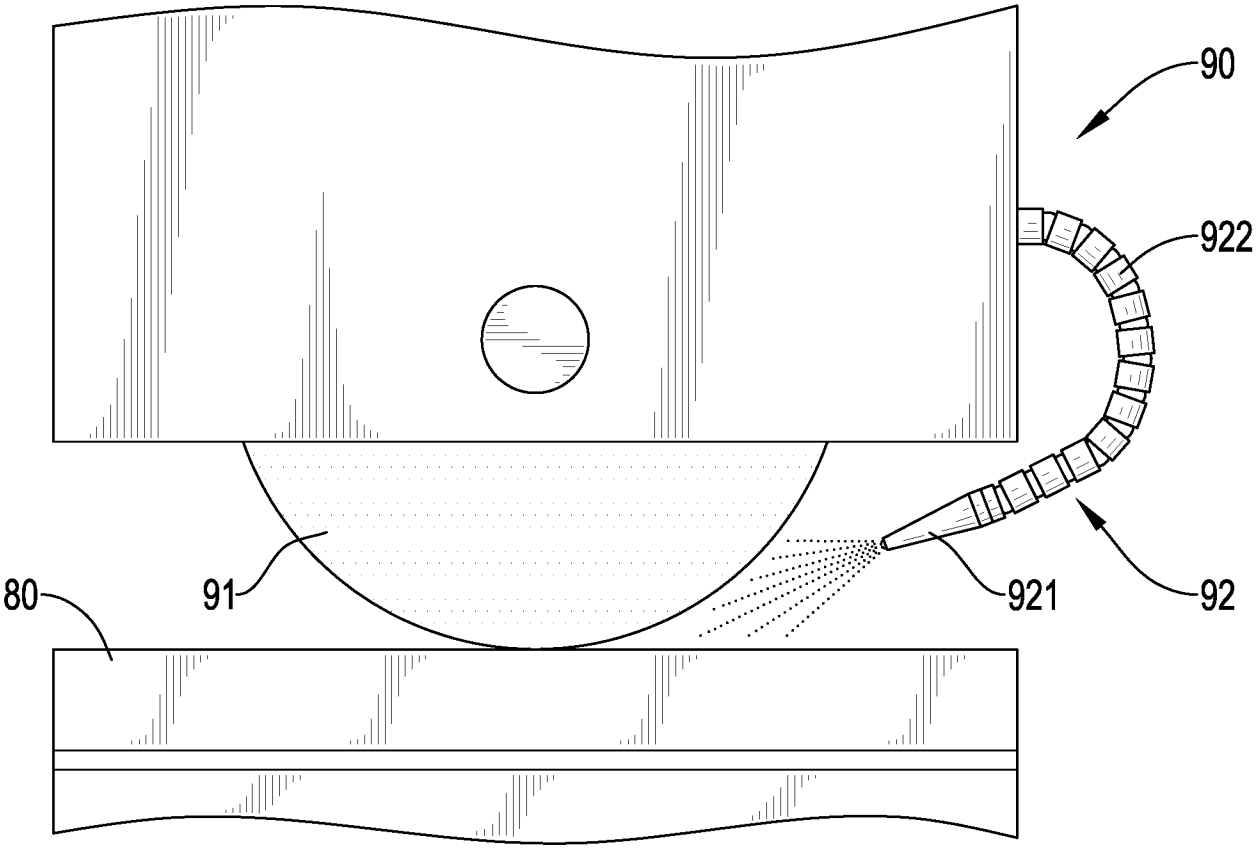
FIG.7 PRIOR ART
FIG. 7 is an enlarged side view of a grinding machine in accordance with the prior art.

With reference to FIGS. 2 and 6, each one of the multiple adjusting holes 14 is radially defined inside the first flange 12 and extends from the outer peripheral surface 122 of the first flange 12 to the inserting groove 13, and each one of the multiple adjusting holes 14 has an internal thread. With reference to FIG. 6, the multiple adjusting holes 14 are arranged at equal angular intervals. With reference to FIGS. 3A and 5, the first coolant passage 15 is axially defined through the tool holder 10 and communicates with the interior of the installing groove 11 and the interior of the inserting groove 13.

Figure 4A:
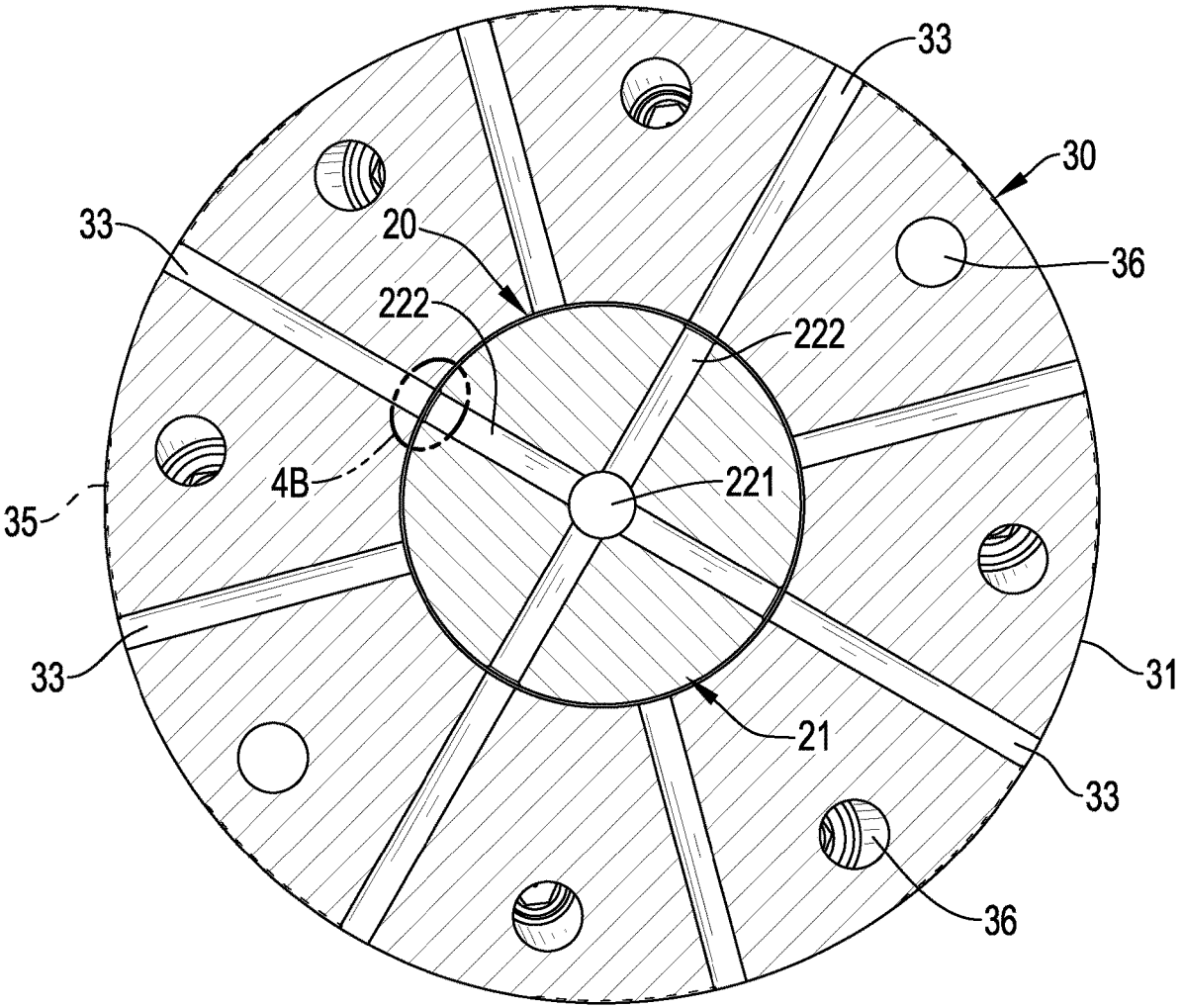
FIG. 4A is a cross-sectional front side view of the grinding wheel assembly in FIG. 1.

With reference to FIGS. 2, 3A, and 4A, the mounting shaft 20 is connected to the tool holder 10. The mounting shaft 20 has a first end 201, a second end 202, a mounting portion 21, a second coolant passage 22, a second flange 24, multiple containing holes 25, and an inserting portion 26. The first end 201 of the mounting shaft 20 is connected to the tool holder 10. The second end 202 is opposite the first end 201 in an axial direction of the mounting shaft 20 and has an external thread. The mounting portion 21 is located between the first end 201 and the second end 202 and near the second end 202. The mounting portion 21 has an external peripheral surface 211 surrounding the central line C of the grinding wheel assembly.

With reference to FIG. 3A, the second coolant passage 22 is defined inside the mounting shaft 20, extends from the first end 201 of the mounting shaft 20 to the external peripheral surface 211 of the mounting portion 21 of the mounting shaft 20, and communicates with the first coolant passage 15 of the tool holder 10. With reference to FIGS. 3A and 4A, the second coolant passage 22 has a central passage section 221 and four guiding passage sections 222. The central passage section 221 axially extends from the first end 201 of the mounting shaft 20 toward the second end 202 of the mounting shaft 20. Each one of the four guiding passage sections 222 is radially defined inside the mounting portion 21 and extends from the central passage section 221 to the external peripheral surface 211 of the mounting portion 21. With reference to FIG. 4A, the four guiding passage sections 222 are arranged at equal angular intervals.

With reference to FIGS. 2 and 5, the second flange 24 is located near the first end 201 of the mounting shaft 20, is combined with the first flange 12 of the tool holder 10, and has a first side surface 241 and a second side surface 242. The first side surface 241 faces the abutting surface 121 of the first flange 12 of the tool holder 10. The second side surface 242 faces opposite directions with the first side surface 241. Each one of the multiple containing holes 25 is defined through the second flange 24, extends from the first side surface 241 to the second side surface 242, and has an internal thread. The multiple containing holes 25 are arranged at equal angular intervals. With reference to FIGS. 2, 3A, and 5, the inserting portion 26 is disposed at the first end 201 of the mounting shaft 20 and is inserted into the inserting groove 13 of the tool holder 10.

With reference to FIGS. 2, 3A, and 4A, the grinding wheel 30 is mounted on the mounting shaft 20 and has two opposite side surfaces respectively facing two opposite directions, a grinding surface 31, a mounting hole 32, multiple third coolant passages 33, a groove 34, multiple flutes 35, and multiple through holes 36. The mounting hole 32 is axially defined through the grinding wheel 30, and is located on and around the mounting portion 21 of the mounting shaft 20. The grinding surface 31 is a peripheral surface and surrounds the mounting hole 32.

Figure 4B:
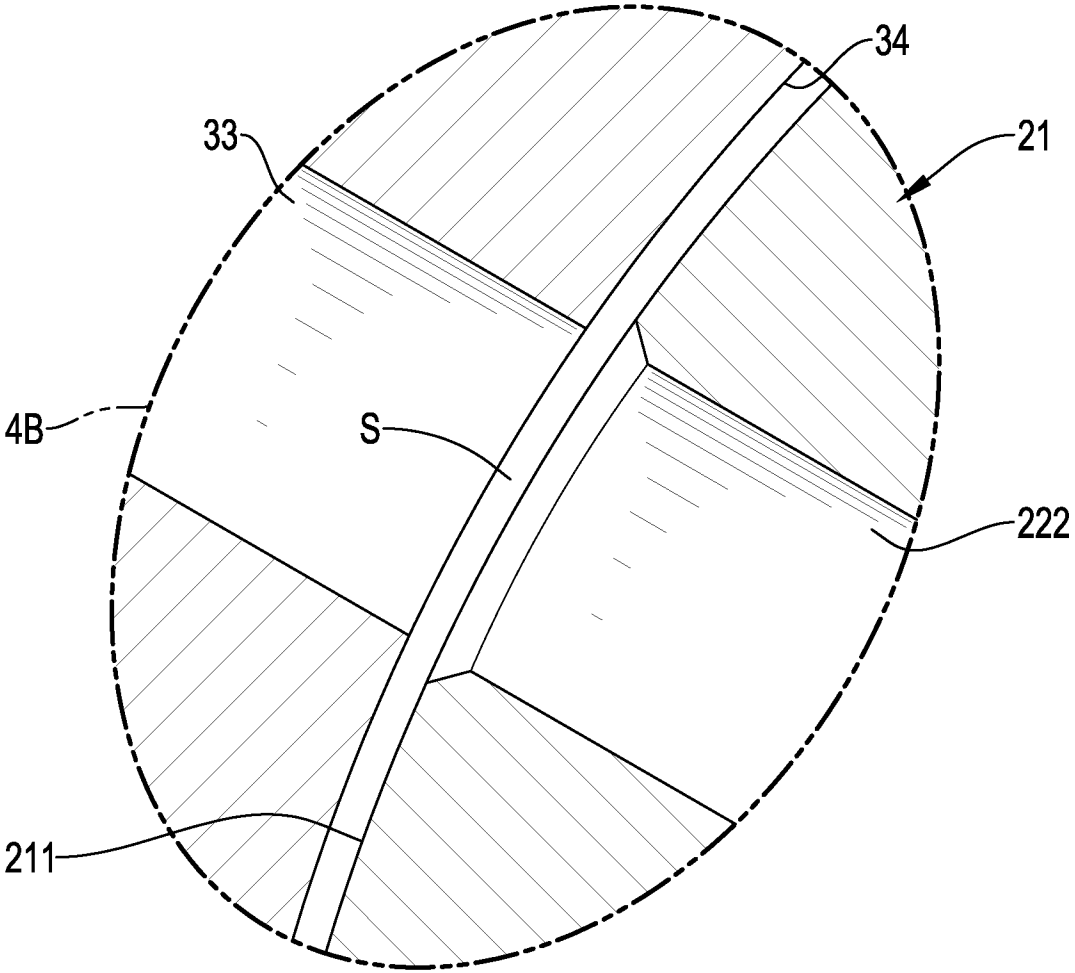
FIG. 4B is a partial enlarged frond side view of the grinding wheel assembly in FIG. 4A.

With reference to FIGS. 3A and 4A, each one of the multiple third coolant passages 33 is radially defined through the grinding wheel 30, extends from the mounting hole 32 to the grinding surface 31, and communicates with the second coolant passage 22 of the mounting shaft 20. With reference to FIGS. 1 and 2, each one of the multiple third coolant passages 33 forms an opening on the grinding surface 31. With reference to FIG. 4A, the multiple third coolant passages 33 are arranged at equal angular intervals. With reference to FIGS. 2 and 4B, the groove 34 is circularly recessed on an inner peripheral surface of the grinding wheel 30 surrounding the mounting hole 32.

Figure 3B:
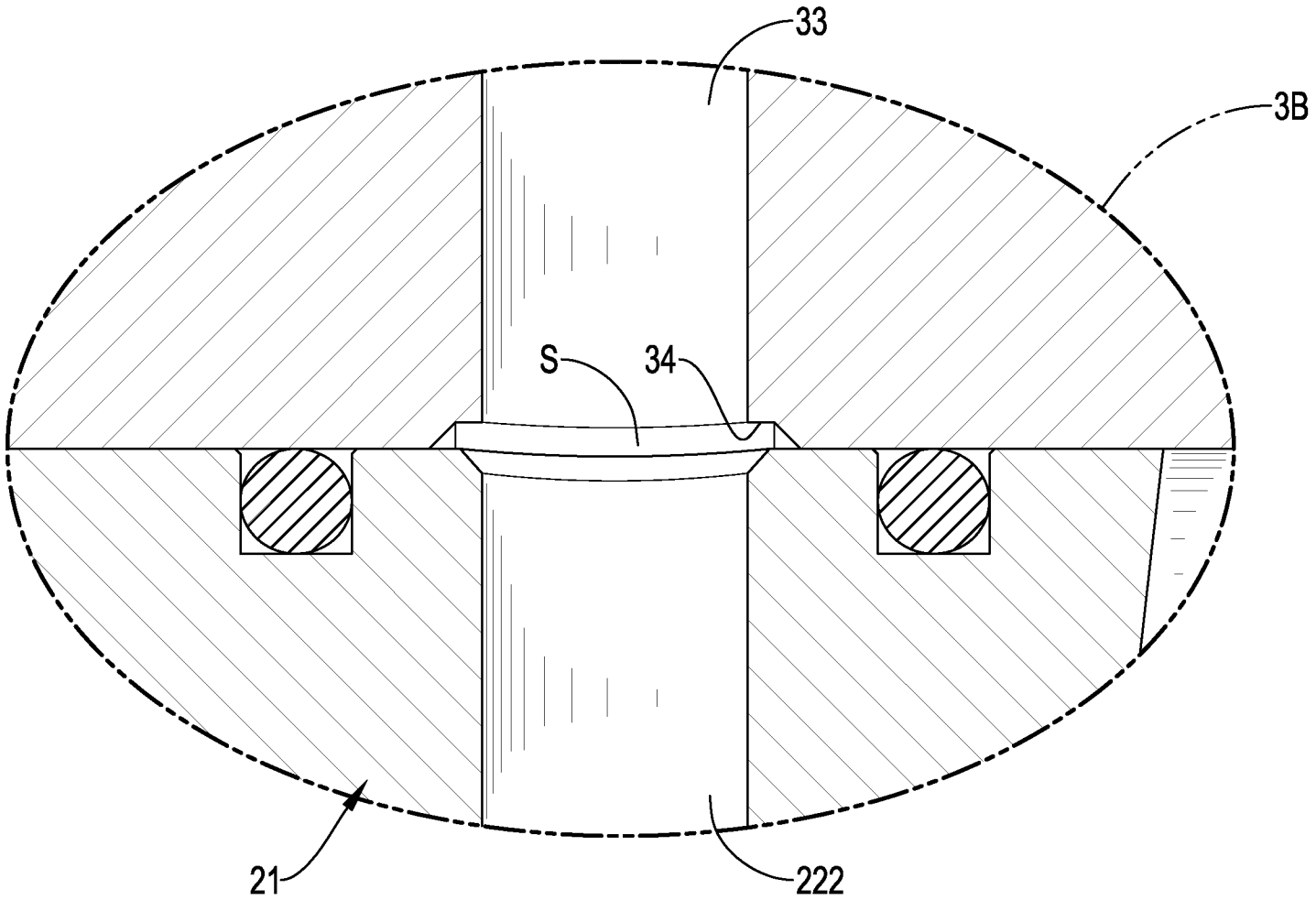
FIG. 3B is a partial enlarged side view of the grinding wheel assembly in FIG. 3A.

With reference to FIGS. 3B and 4B, the grinding wheel assembly further has a communicating space S enclosed by the groove 34 of the grinding wheel 30 and the external peripheral surface 211 of the mounting portion 21 of the mounting shaft 20. With reference to FIGS. 3B, 4A, and 4B, the communicating space S is annular and communicates with the four guiding passage sections 222 of the second coolant passage 22 and the multiple third coolant passages 33.

With reference to FIGS. 1, 2, and 4A, each one of the multiple flutes 35 is recessed on the grinding surface 31, extends to two opposite sides of the grinding surface 31, and has a middle portion. The middle portions of the multiple flutes 35 respectively communicate with the multiple third coolant passages 33. With reference to FIGS. 2 and 5, each one of the multiple through holes 36 is defined through the grinding wheel 30 and extends from one of the two opposite side surfaces of the grinding wheel to the other one of the two opposite side surfaces of the grinding wheel 30. The multiple through holes 36 are utilized to reduce a weight of the grinding wheel 30.

With reference to FIGS. 2 and 3A, the fixing nut 40 is screwed onto the second end 202 of the mounting shaft 20. The fixing nut 40 and the mounting shaft 20 together clamp the grinding wheel 30.

With reference to FIG. 5, the multiple spacers 60 are respectively contained in the multiple containing holes 25, and the multiple pressing set screws 50 are respectively screwed into the containing holes 25 and respectively press the multiple spacers 60 against the multiple containing recess 123 on the abutting surface 121 of the first flange 12. Users can slightly adjust a relative inclined angle between the tool holder and the mounting shaft 20 via turning one of the multiple pressing set screws 50.

With reference to FIG. 6, the multiple adjusting set screws 70 are respectively screwed into the multiple adjusting holes 14 and abut against the inserting portion 26 of the mounting shaft 20. Users can slightly adjust coaxiality of the tool holder 10 and the mounting shaft 20 via turning one of the multiple adjusting set screws 70.

In use, the grinding wheel assembly is mounted on a spindle with a coolant passage in a grinding machine via the installing groove 11. When the grinding machine is working, a coolant flows through the coolant passage of the spindle, the first coolant passage 15 of the tool holder 10, the second coolant passage 22 of the mounting shaft 20, and the multiple third coolant passages 33 of the grinding wheel 30. Then the coolant is ejected from the opening formed by each one of the multiple third coolant passages 33 to cool down the grinding wheel 30 and a workpiece under processing.

The grinding wheel assembly has the first coolant passage 15, the second coolant passage 22, and the multiple third coolant passages 33 for a coolant to flow through. Thereby, a grinding machine having the grinding wheel assembly can cool down a workpiece and the grinding wheel 30 without setting up any pipeline or nozzle, which makes the grinding machine more space-saving. The coolant is ejected from the opening on the grinding surface 31 directly to the contact point of the grinding wheel 30 and a workpiece, so that the workpiece and the grinding wheel 30 can be cooled down more effectively.

Even though numerous characteristics and advantages of the present invention have been set forth in the foregoing description, together with details of the structure and features of the present invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A grinding wheel assembly with a coolant passage system, the grinding wheel assembly comprising:

a tool holder having a first coolant passage defined through the tool holder along a longitudinal direction of the tool holder;

a mounting shaft connected to the tool holder and having a first end connected to the tool holder;

a second end opposite the first end of the mounting shaft in an axial direction of the mounting shaft;

a mounting portion located between the first end and the second end and having an external peripheral surface; and a second coolant passage defined inside the mounting shaft, extending from the first end of the mounting shaft to the external peripheral surface of the mounting portion, and communicating with the first coolant passage of the tool holder; and a grinding wheel having a mounting hole defined through the grinding wheel along a longitudinal direction of the grinding wheel and located on and around the mounting portion of the mounting shaft;

a grinding surface surrounding the mounting hole; and at least one third coolant passage defined through the grinding wheel, extending from the mounting hole to the grinding surface, and communicating with the second coolant passage of the mounting shaft, wherein the grinding wheel has two side surfaces respectively facing two opposite directions, and multiple through holes defined through the grinding wheel, extending from one of the two side surfaces of the grinding wheel to the other one of the two side surfaces of the grinding wheel, arranged around the mounting hole of the grinding wheel, and spaced from said third coolant passage;

the tool holder has a first flange located at an end of the tool holder and having an outer peripheral surface and an abutting surface facing the mounting shaft, an inserting groove formed in the first flange, formed through the abutting surface of the first flange, and surrounded by the outer peripheral surface of the first flange, and multiple adjusting holes radially defined through the first flange and extending from the inserting groove to the outer peripheral surface of the first flange;

the mounting shaft has an inserting portion disposed at the first end of the mounting shaft and inserted into the inserting groove of the tool holder; and the grinding wheel assembly has multiple adjusting set screws respectively screwed into the multiple adjusting holes and abut against the inserting portion of the mounting shaft.

2. The grinding wheel assembly with a coolant passage system as claimed in claim 1 further having a communicating space, wherein the at least one third coolant passage of the grinding wheel includes multiple third coolant passages;

the grinding wheel has a groove circularly recessed on an inner peripheral surface of the grinding wheel surrounding the mounting hole of the grinding wheel; and the communicating space is enclosed by the groove of the grinding wheel and the external peripheral surface of the mounting portion of the mounting shaft and communicates with the second coolant passage of the mounting shaft and the multiple third coolant passages of the grinding wheel.

3. The grinding wheel assembly with a coolant passage system as claimed in claim 2, wherein each one of the multiple third coolant passages is radially defined through the grinding wheel; and the multiple third coolant passages are arranged at equal angular intervals.

4. The grinding wheel assembly with a coolant passage system as claimed in claim 3, wherein the grinding wheel has multiple flutes recessed on the grinding surface and extending to two opposite sides of the grinding surface.

5. The grinding wheel assembly with a coolant passage system as claimed in claim 4, wherein each one of the multiple flutes has a middle portion; and the middle portions of the multiple flutes respectively communicate with the multiple third coolant passages.

6. The grinding wheel assembly with a coolant passage system as claimed in claim 2, wherein the second coolant passage has a central passage section extending from the first end of the mounting shaft toward the second end of the mounting shaft;

at least one guiding passage section radially defined inside the mounting portion of the mounting shaft and extending from the central passage section to the external peripheral surface of the mounting portion of the mounting shaft.

7. The grinding wheel assembly with a coolant passage system as claimed in claim 6, wherein the grinding wheel has multiple flutes recessed on the grinding surface and extending to two opposite sides of the grinding surface.

8. The grinding wheel assembly with a coolant passage system as claimed in claim 7, wherein each one of the multiple flutes has a middle portion; and the middle portions of the multiple flutes respectively communicate with the multiple third coolant passages.

9. The grinding wheel assembly with a coolant passage system as claimed in claim 2, wherein the grinding wheel has multiple flutes recessed on the grinding surface and extending to two opposite sides of the grinding surface.

10. The grinding wheel assembly with a coolant passage system as claimed in claim 9, wherein each one of the multiple flutes has a middle portion; and the middle portions of the multiple flutes respectively communicate with the multiple third coolant passages.

11. The grinding wheel assembly with a coolant passage system as claimed in claim 2, wherein the grinding wheel is a diamond grinding wheel.

12. The grinding wheel assembly with a coolant passage system as claimed in claim 1, wherein the grinding wheel is a diamond grinding wheel.

13. The grinding wheel assembly with a coolant passage system as claimed in claim 1 further having multiple spacers and multiple pressing set screws, wherein the mounting shaft has a second flange located near the first end of the mounting shaft, combined with the first flange of the tool holder, and having a first side surface facing the abutting surface of the first flange; and a second side surface facing opposite directions with the first side surface of the second flange; and multiple containing holes defined through the second flange, extending from the first side surface of the second flange to the second side surface of the second flange, and arranged circularly;

the multiple spacers are respectively contained in the multiple containing holes; and the multiple pressing set screws are respectively screwed into the multiple containing holes of the mounting shaft and respectively press the multiple spacers against the abutting surface of the first flange of the tool holder.

14. The grinding wheel assembly with a coolant passage system as claimed in claim 1, wherein the grinding wheel has multiple flutes recessed on the grinding surface and extending to two opposite sides of the grinding surface.

15. The grinding wheel assembly with a coolant passage system as claimed in claim 14, wherein each one of the multiple flutes has a middle portion; and the middle portions of the multiple flutes respectively communicate with the multiple third coolant passages.

* * * * *